United States Patent [19]

Friedman

[11] Patent Number: 4,971,244

[45] Date of Patent: Nov. 20, 1990

[54] DEPOSIT, COLLECTION AND DELIVERY RECEPTACLE FOR CLOTHING

[76] Inventor: Daniel S. Friedman, 1533 Hillhaven Dr., Marietta, Ga. 30062

[21] Appl. No.: 382,397

[22] Filed: Jul. 20, 1989

[51] Int. Cl.[5] ..... B65D 91/00

[52] U.S. Cl. ..... 232/1 B; 232/47

[58] Field of Search ..... 232/1 B, 44, 47, 48; 235/98 R, 99 R, 99 A

[56] References Cited

U.S. PATENT DOCUMENTS

| | | | |
|---|---|---|---|
| 494,050 | 3/1893 | Anderson | 232/1 B |
| 1,810,563 | 6/1931 | Katzman | 232/1 B |
| 1,959,790 | 5/1934 | Katzman | 232/1 B |
| 3,336,665 | 8/1967 | Proctor | 235/98 R X |
| 4,603,791 | 8/1986 | Spierer et al. | 235/98 R X |

FOREIGN PATENT DOCUMENTS

| | | | |
|---|---|---|---|
| 0002300 | 1/1985 | Japan | 232/1 B |

*Primary Examiner*—Robert W. Gibson, Jr.

[57] ABSTRACT

A deposit, collection and delivery receptacle for clothing that is intended for use in the dry cleaning and laundry industry. The receptacle serves to assure the efficient operation of a pick-up and delivery service to residential and commercial customers. The receptacle is installed on the premises of the customer in a location that is accessible to the business operator at all times during normal business hours. The business operator can pick up and deliver clothing at his convenience. The customer can deposit clothing that requires cleaning and retrieve cleaned clothing at his convenience. In order to prevent disputes between the business operator and the customer over the quantity of clothing deposited into the receptacle, said receptacle can contain the means to count or determine the quantity of clothing deposited therein.

3 Claims, 4 Drawing Sheets

DEPOSIT, COLLECTION AND DELIVERY RECEPTACLE FOR CLOTHING

BACKGROUND OF THE INVENTION

Dry cleaning and laundry business operators who attempt to provide pick-up and delivery service are confined to schedule said service only when the customer can be present to conduct the transaction. Even after a schedule has been arranged, unforeseen circumstances can occur which causes the customer not to be present or the route driver to be delayed in arriving. These circumstances result in unsuccessful pick-up or delivery attempts made by the route driver and inconvenience to the customer as said customer does not receive service as scheduled. In a previous attempt to overcome these problems, the customer would place clothing into a laundry bag and leave said laundry bag in a predetermined outdoor location for the business operator to pick up. This method has resulted in disputes between the business operator and the customer over the quantity of clothing left in the laundry bag; with the problem of scheduling delivery of the cleaned clothing to the customer still remaining. The business operator and the customer will benefit from the invention presented in this disclosure as said invention will overcome the problems associated with operating a pick-up and delivery service.

Accordingly, several objectives and benefits of the invention presented in this disclosure are; the business operator can efficiently provide pick-up and delivery service as it is not necessary for the customer to be present to conduct transactions, the invention can count and display the quantity of clothing deposited therein to prevent disputes between the business operator and the customer, and the customer can complete all transactions from his home or business at his convenience.

Further objectives and benefits of the invention will become apparent from a consideration of the drawings and ensuing description thereof.

DETAILED DESCRIPTION OF THE INVENTION

Figure 1:
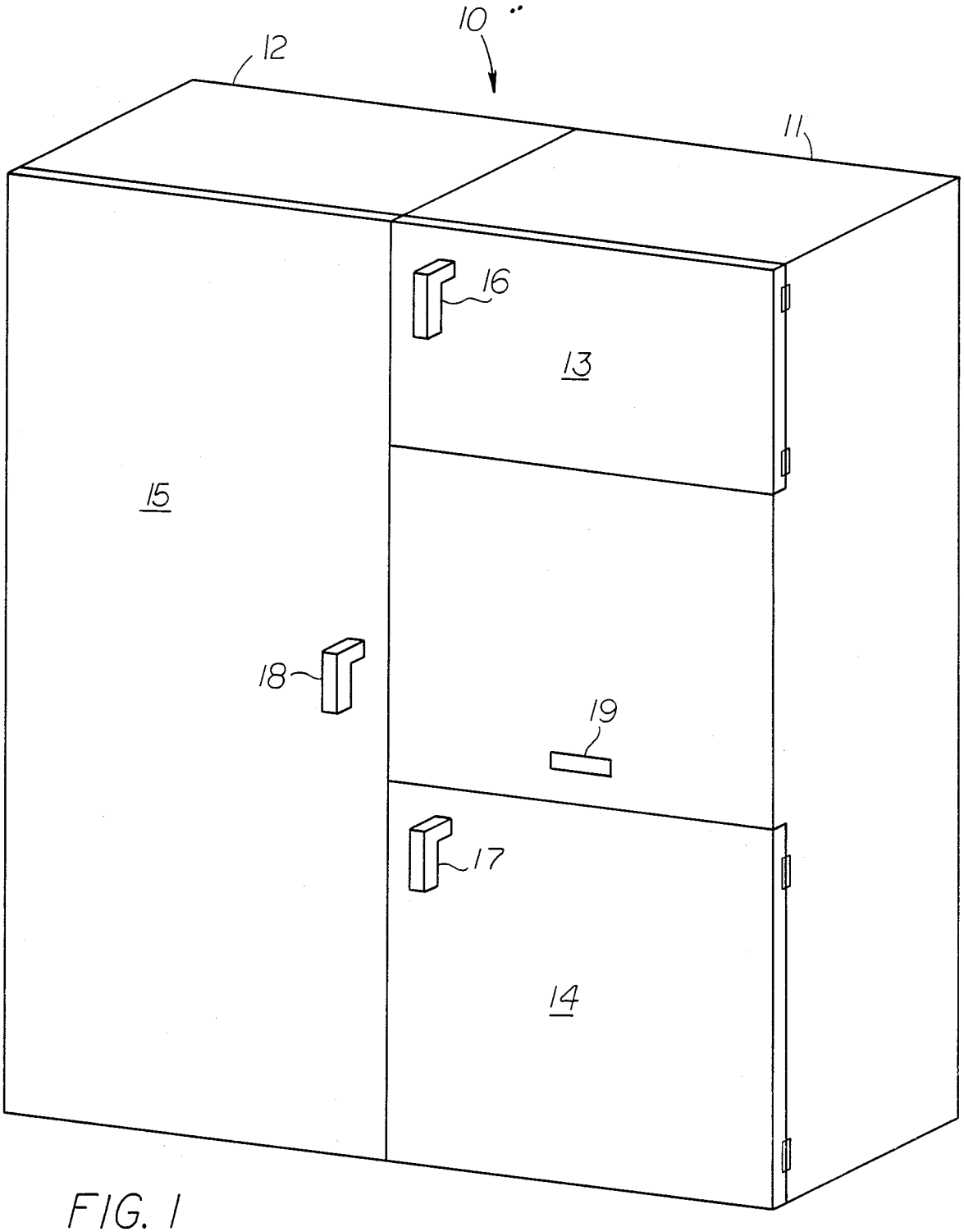
FIG. 1 is a perspective representation of a deposit, collection and delivery receptacle, representing one embodiment of the invention.

As shown in FIG. 1, the receptacle 10, can consist of two sections, the deposit and collection section 11 and the delivery section 12. The receptacle 10 can be manufactured as one complete assembly, but for ease of shipment and handling the receptacle 10 can also be manufactured as two separate components, the deposit and collection section 11 and the delivery section 12. The receptacle 10 can be manufactured of sheet metal or other suitable material using industry standard procedures and methods. The receptacle 10 can be manufactured so it will prevent moisture from entering within. The deposit and collection section 11 can have a deposit door 13 through which the customer can deposit clothing that requires cleaning, and a collection door 14 through which the clothing that was deposited by the customer can be emptied by the business operator. The delivery section 12 can have a delivery door 15 through which the business operator can drop off cleaned clothing for the customer to pick up. Deposit door 13, collection door 14 and delivery door 15 can each have a handle 16, 17 and 18 respectively, with a locking mechanism contained within said handles, so only the persons authorized to have access to the receptacle 10 can do so. Handles 16, 17 and 18 can be of any appropriate commercially available type. The deposit and collection section 11 can have a window 19 through which the counter (shown and described in FIG. 3) can be read.

Figure 2:
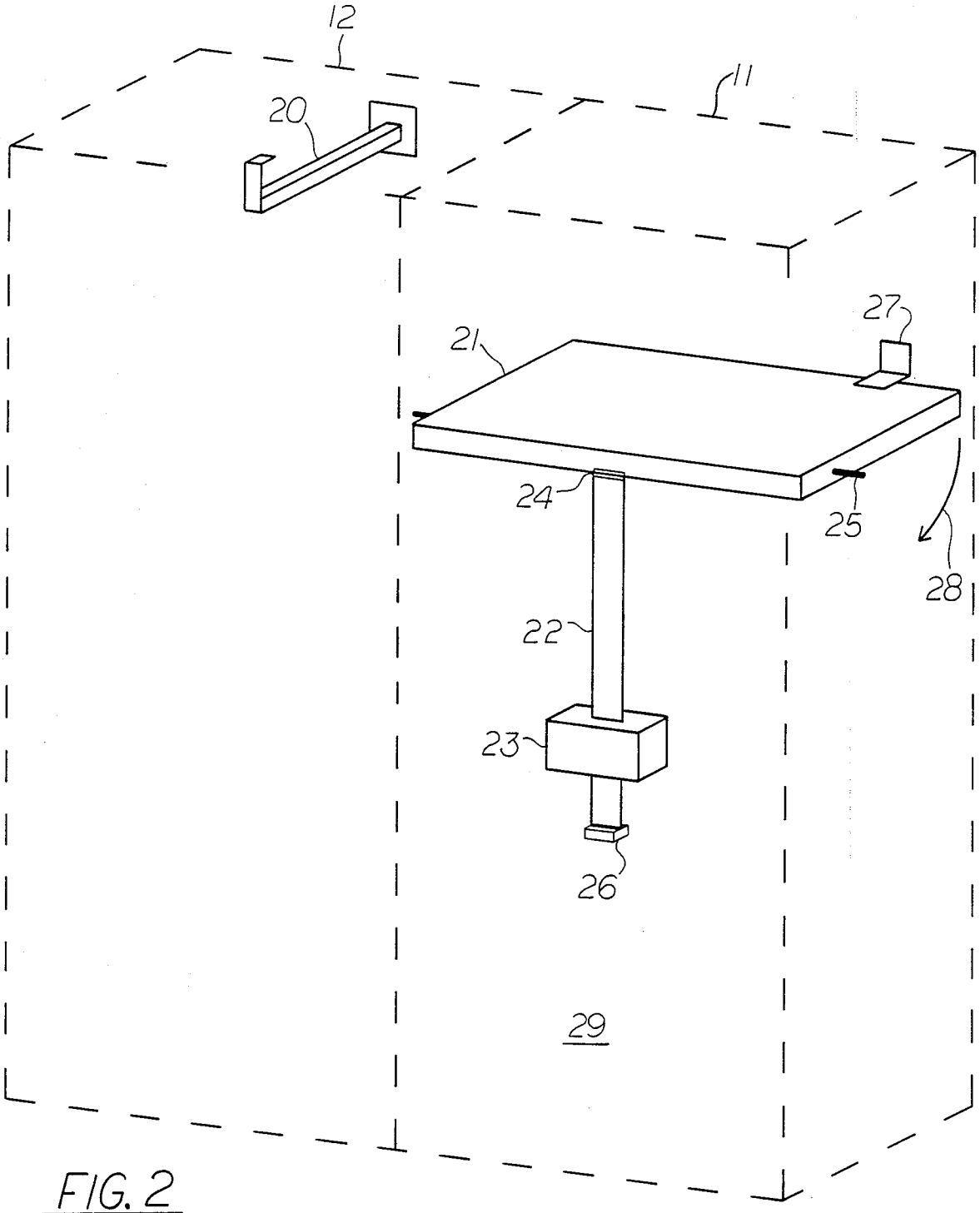
FIG. 2 is a perspective representation of the counting mechanism and hanging rod installed within the receptacle.

As shown in FIG. 2, the delivery section generally shown as 12 can have a hanging rod 20 installed therein on which the business operator can hang clothing to be returned to the customer. The deposit and collection section generally shown as 11 can contain an actuating plate 21 for the purpose of initiating a counting stroke, by way of connecting rod 22, onto the counter assembly 23. Actuating plate 21 and connecting rod 22 are attached by hinge 24. Hinge 24 can be of any appropriate commercially available type. Counter assembly 23 is mounted directly onto the front interior wall of the deposit and collection section 11. Counter assembly 23 will allow connecting rod 22 to easily and smoothly pass through said assembly in either direction (the interconnection of counter assembly 23 and connecting rod 22 is shown and described in FIG. 3). The actuating plate 21 and connecting rod 22 can be mounted onto balancing rod 25. Balancing rod 25 can act as the pivot point or fulcrum of movement of actuating plate 21 and connecting rod 22. Balancing rod 25 can also serve as the means of mounting actuating plate 21 and connecting rod 22 onto the interior wall of the deposit and collection section 11. Actuating plate 21 and connecting rod 22 can be counter balanced into the position shown in FIG. 2 by counter weight 26. Stop plate 27 is mounted on the rear interior wall of the deposit and collection section 11 and will not allow actuating plate 21 and connecting rod 22 to travel beyond the position shown in FIG. 2.

Referring to FIG. 2, clothing can be placed onto actuating plate 21, preferably one piece at a time (through deposit door 13 as was shown and described in FIG. 1). The weight of the clothing causes actuating plate 21 to travel in the direction indicated by arrow 28. When actuating plate 21 moves, connecting rod 22 will deliver a counting stroke to counter assembly 23. Since actuating plate 21 and connecting rod 22 are counter balanced, said parts will return to the position shown in FIG. 2 after the clothing being deposited has fallen into in the collection area generally shown as 29. The counter assembly 23 will not register a counting stroke as actuating plate 21 and connecting rod 22 return to the position indicated in FIG. 2.

Figure 3:
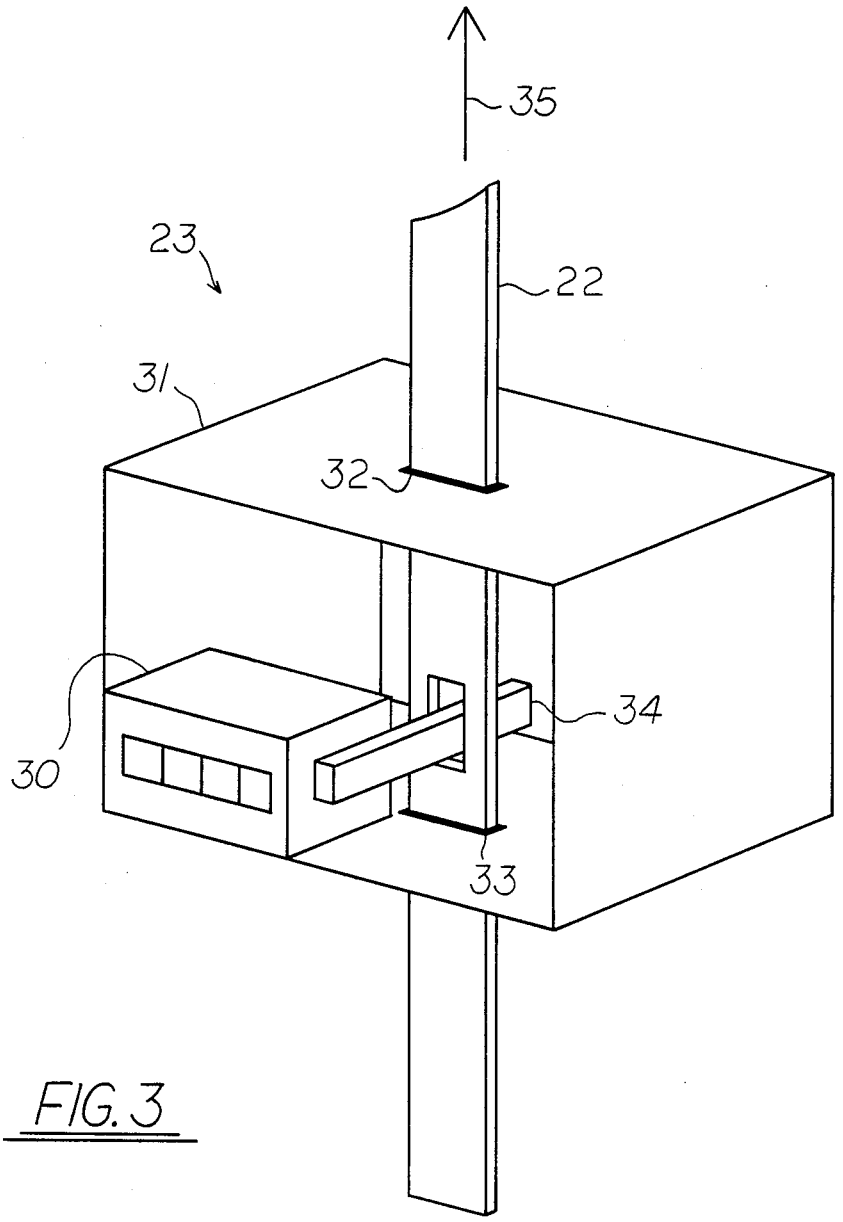
FIG. 3 is a perspective representation of the counter assembly installed within the receptacle.

As shown in FIG. 3, the counter assembly 23 can consist of counter 30 and counter housing 31. The counter 30 can be of any appropriate commercially available type including, but not limited to, the following specification; Mechanical type, four digit, no ability to reset, ratchet driven with spring return, one count registered per rotation through arc of twenty degrees counter clockwise, ratchet torque is two ounce/inch. The counter housing 31 can have two slots 32 and 33 for the purpose of guiding connecting rod 22 (shown partially) across counter ratchet 34.

Referring to FIG. 3, as connecting rod 22 travels in the direction indicated by arrow 35, the counter ratchet 34 will be moved counter clockwise causing a count to be registered on counter 30. Counter ratchet 34 will reset for another counting stroke only when connecting rod 22 returns to its normal position as shown in FIG. 3 (movement of connecting rod 22 was shown and described in FIG. 2).

Figure 4:
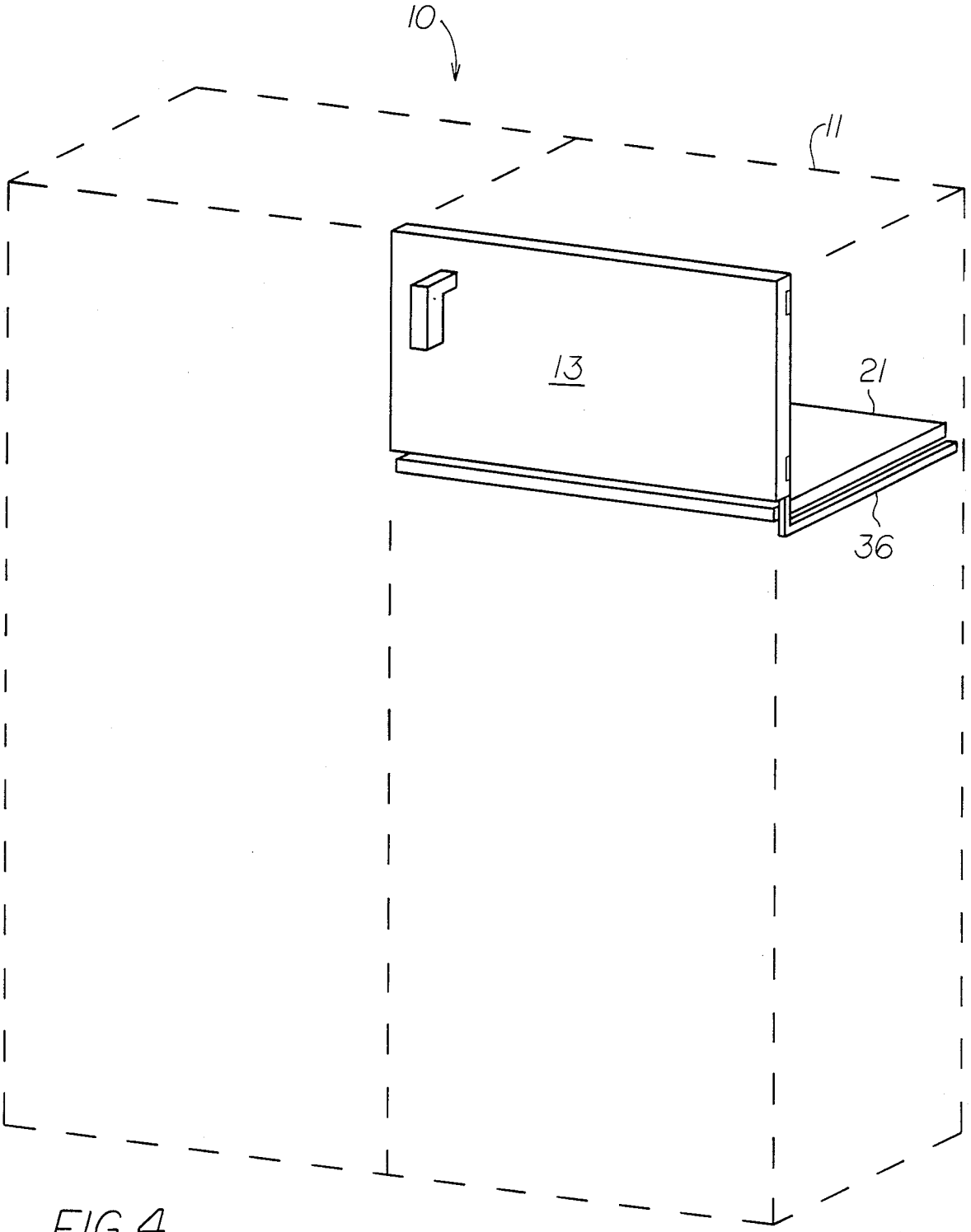
FIG. 4 is a perspective representation of the actuating plate restraining bar installed within the receptacle.

As shown in FIG. 4, the deposit and collection section, generally shown as 11, can contain a mechanism that will not allow actuating plate 21 to move when deposit door 13 is in the open position. Restraining bar 36 is mounted onto the deposit door 13 at ninety degrees from said door. Restraining bar 36 will move under actuating plate 21 as deposit door 13 is opened thus restraining said plate from any possible movement (stop plate 27 shown and described in FIG. 2 will not allow actuating plate 21 to move in the opposite direction).

Therefore, the invention provides an improved means to operate a dry cleaning and laundry pick-up and delivery service. While the above description contains many specifications, these should not be construed as limitations on the scope of the invention, but rather as an exemplification of one preferred embodiment thereof. Since other variations are possible, the scope of the invention should be determined not by the embodiment illustrated herein, but by the appended claims and their legal equivalents.

I claim:

1. In combination: a receptacle used for providing dry cleaning and/or laundry pick-up and delivery service, of which said receptacle comprises; an opening to deposit clothing that requires said service, an opening to collect clothing from within said receptacle, an opening to deliver clothing upon completion of said service, and an area within said receptacle to store both clean and soiled articles subject to said service.

2. The combination defined in claim 1, and which includes a mechanical device used to count or determine the quantity of clothing deposited into the receptacle.

3. The combination defined in claim 2, and which includes a display to communicate the quantity of clothing deposited into the receptacle.

* * * * *